United States Patent [19]

List et al.

[11] 4,126,115

[45] Nov. 21, 1978

[54] INTERNAL COMBUSTION ENGINE

[75] Inventors: Hans List, 126, Heinrichstrasse, Graz, Austria; Josef Greier, Graz, Austria; Bertram Obermayer, Graz, Austria; Heinz Fachbach, Graz, Austria; Othmar Skatsche, Graz, Austria

[73] Assignee: Hans List, Graz, Austria

[21] Appl. No.: 834,657

[22] Filed: Sep. 19, 1977

[30] Foreign Application Priority Data

Sep. 17, 1976 [AT] Austria ..... 6945/76

[51] Int. Cl.[2] ..... F02F 1/34; F02B 77/00; F01P 1/02

[52] U.S. Cl. ..... 123/198 E; 123/41.7; 181/204

[58] Field of Search ..... 123/198 E, 195 C, 195 S, 123/41.6, 41.7, 41.79; 181/204

[56] References Cited

U.S. PATENT DOCUMENTS

| | | | |
|---|---|---|---|
| 3,601,101 | 8/1971 | Thien et al. | 181/204 X |
| 3,684,053 | 8/1972 | Fachbach et al. | 181/204 |
| 3,693,602 | 9/1972 | Thien et al. | 181/204 X |
| 3,863,617 | 2/1975 | Thien et al. | 123/198 E X |
| 3,880,134 | 4/1975 | Thien et al. | 123/198 E X |
| 3,949,726 | 4/1976 | List | 123/198 E |
| 3,951,114 | 4/1976 | Fachbach et al. | 123/198 E X |
| 3,964,462 | 6/1976 | Thien et al. | 123/198 E |

*Primary Examiner*—Ira S. Lazarus

*Attorney, Agent, or Firm*—Watson, Cole, Grindle & Watson

[57] ABSTRACT

An internal combustion engine with auxiliary machines driven by a V-belt and pulley from the engine the engine and the pulley being enclosed by a sound suppressing encapsulation, the auxiliary machines being mounted externally of the encapsulation, the V-belt extending at least partly through a sound absorbing funnel-shaped leadthrough to the pulley, the funnel-shaped leadthrough providing a silencer unit and a passageway for the intake of cooling air into the encapsulation.

3 Claims, 2 Drawing Figures

INTERNAL COMBUSTION ENGINE

This invention relates to internal combustion engines and is especially concerned with improvements for reducing noise emission of internal combustion engines.

It is common knowledge that surface noise emanation from internal combustion engines can be reduced by providing the inner engine unit through which driving power is transmitted and which is, therefore, a sound transmitting solid body, with a body-resonance-absorbing outer casing or hood.

In an existing arrangement of this kind a rigid frame structure is provided around the engine and secured to the latter by means of body-resonance-absorbing elements, and the wall sections and other parts of the noise-suppressing encapsulation are fitted to this frame with the aid of bars, or strips, extending along their exterior edges. The engine itself is mounted on the support or chassis by means of body-resonance-absorbing mounting struts which extend through the encapsulation walls.

In another existing arrangement which works on the same principle, the conventional crankcase is replaced by a skeleton-frame-support for the drive unit in which the lower region is sealed off, or encased, in an oil-wetted part of a capsule. All ancillary units and auxiliary machinery are arranged in the upper region and this is encased by a non-oil-wetted hood or upper part of the capsule. Again the encapsulation as a whole is supported relative to the engine by means of elastic elements, one of which extends in frame-like manner around the drive unit mounting and provides the required seal between the oil wetted part and the upper, non-oil-wetted part of the capsule. However, this second known arrangement involves extensive constructional modification and redesigning with regard to the engine and drive unit as a whole as compared with conventional engine design. Moreover, even with such re-design to provide the best dispositions within and for the full encapsulation, the resultant arrangement presents the disadvantage that access to normal service and maintenance points for the auxiliary machinery and units is substantially impaired by comparison with a conventional engine-power unit which is entirely without provisions for the suppression of noise emanation.

In the known encapsulation arrangements, there has to be some provision for ventilation and cooling the interior of the capsule, or the non-oil-wetted part. This is done by means of a small fan provided additionally to the main fan unit, and the intake and exhaust openings for the cooling air are each provided with a funnel-shaped passageway which is lined with a suitable, sound absorbing material. It has also been proposed to combine the cooling air outlet passage or pipe with the exhaust system in such a way that the cooling air will substantially contribute to the cooling of the hot exhaust pipes thereby preventing a build-up of heat in the interior of the encapsulation.

According to yet another prior proposal, the engine is not encapsulated but a sound-proofing casing is provided for the conventional V-belt pulley drive on the crankshaft through which drive is transmitted to auxiliary machinery and ancillary units. This V-belt pulley drive accounts for a very large share of noise emission from the engine. In this case sound absorbing pads or like elements are provided in the casing at the points where the V-belt is conducted through openings in the walls of the casing to reduce sound transmission by air through these openings. The main drawback of such arrangement is that they do not provide any remedy for reducing engine surface-noise-emission.

The present invention aims to avoid the disadvantages of these earlier constructions and to ensure maximum reduction of engine surface noise emission whilst at the same time fully preserving free access to auxiliary machinery and equipment.

According to this invention, an internal combustion engine is provided with auxiliary machines or equipment driven by a V-belt and pulley from the engine wherein the engine and the pulley are enclosed by a sound-suppressing encapsulation whilst the auxiliary machines or equipment are mounted externally of the encapsulation, the V-belt extending at least partly through a sound absorbing funnel-shaped lead through to the pulley, the funnel-shaped lead through providing a silencer unit and a passageway for the intake of cooling air into the encapsulation.

The present invention is therefore basically applied to an internal combustion engine of the kind which is associated with auxiliary machines or units, driven by means of a V-belt and a V-belt pulley on the crankshaft, said pulley being provided with a noise-suppressing encapsulation and the V-belt being conducted through the walls of said encapsulation by means and with the aid of a funnel-shaped lead through which is internally lined with an acoustically insulating material. The engine is provided, in conventional manner, with a noise-suppressing exterior casing in the form of a capsule which includes the encapsulation of the V-belt pulley, but the auxiliary machines and units are all sited externally of the encapsulation. The funnel-shaped lead-through is provided to conduct the V-belt and the cooling air through the walls of said capsule, and in this constitutes a sound-absorbing silencer. By reason of this provision, full accessibility of the auxiliary machinery is successfully combined with full encapsulation of engine as well as of the V-belt pulley on the crankshaft. If, in such an arrangement, the cooling air inlet opening were sited in the normal conventional position, the required airflow and circulation through the capsule would be seriously affected by the further openings through which the V-belt is conducted through the walls of the encapsulation as cooling air would escape through these further openings and give rise to a considerable amount of noise radiation to the outside.

The invention also affords the additional advantage of a considerable constructional simplification because the silencer means for the cooling air intake, which is required anyway, is also used as silencer means for the V-belt lead through openings in the capsule walls. Furthermore, there can be no escape or loss of cooling air through these V-belt lead-through openings because the cooling air is now drawn into the encapsulation at this point by the fan which is within the capsule.

In further development of this invention, said common funnel guide for the V-belt leadthrough and the intake of cooling air into the capsule may take the form of a continuous slot, or slit whereof the outer contour follows, in slightly spaced relationship, the outlines of the pulley and of the V-belt, as such an arrangement will provide the best possible conditions for the said slot or slit to perform the dual silencer function for the cooling air intake and for the V-belt leadthrough.

Advantageously, the funnel guide may be formed in a block of sound absorbing material which is secured, e.g. adhesively, to the cover of the outer engine capsule.

The invention will be more specifically explained and described with reference to an exemplary embodiment thereof shown in the accompanying drawings wherein.

Figure 1:
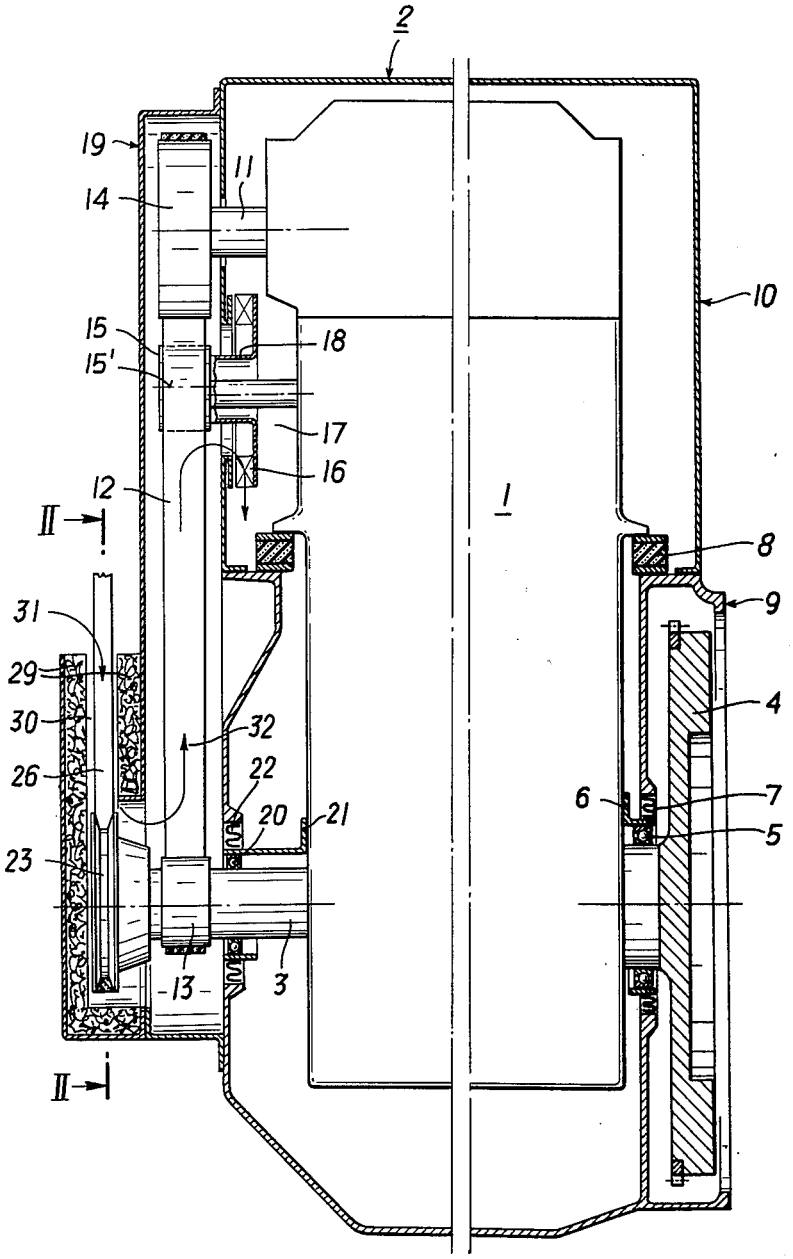
FIG. 1 is a diagrammatic view of an engine, wherein the main engine parts are omitted, being immaterial for the purposes of this invention, and certain other parts are shown as a medial vertical section.
Figure 2:
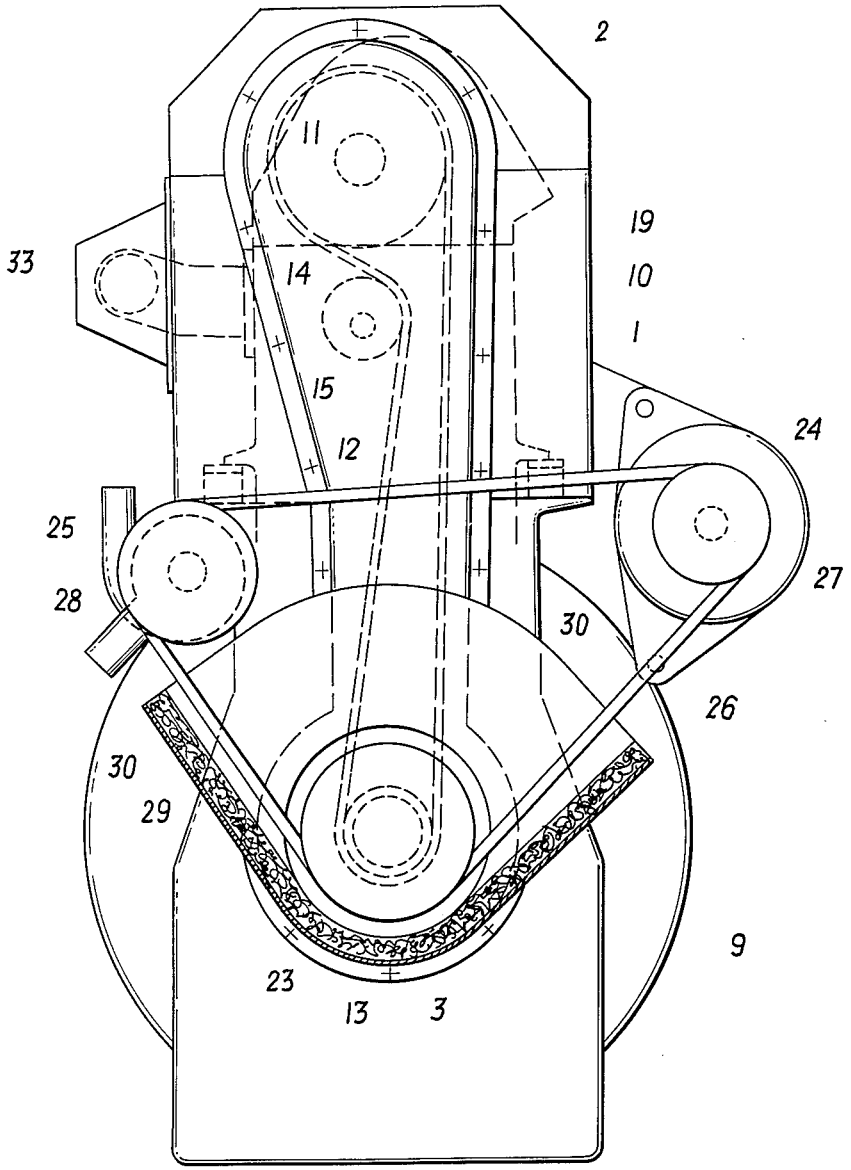
FIG. 2 is a corresponding side view, partly in section taken on the line II—II in FIG. 1.

Referring to the embodiment the engine is enclosed within an outer casing or capsule 2. The engine crankshaft 3 carries a flywheel 4 and the end of the crankshaft passes through a seal 5 mounted in the lower capsule part 9 by means of a mounting bracket 6 connected to the engine or crankshaft housing. Relative movements between engine and capsule walls are permitted by an elastic sealing means 7. The lower capsule part 9 is secured to the engine by means of a body-resonance absorbing element 8 and an upper capsule part 10 is secured to the lower capsule part 9. The encapsulation is completed by a cover 19 at the frontal end of the engine.

The engine 1 comprises an overhead camshaft 11 to which drive is transmitted from the crankshaft 3 by means of a toothed belt 12, a driven pinion 13 on the crankshaft 3 and driving pinion 14 on the camshaft 11. A tension pulley 15 of this drive transmission is drivingly connected by means of a sleeve 18 with a fan 16 which draws cooling air into the interior 17 of the upper capsule part 10. This tension pulley 15 is mounted eccentrically on an axle 15' which is rigidly secured to the crankshaft housing.

The lower capsule part 9 has a forward opening through which the crankshaft 3 extends, there being a seal 20 secured by a mounting bracket 21 to the engine and a further elastic seal 22 extends between the mounting bracket 21 and the capsule part 9.

Drive is transmitted from a V-belt pulley 23 on the crankshaft 3 to the auxiliary machinery comprising a dynamo or generator 24 and to the water pump 25 by means of a V-belt 26 which is looped around the respective pulleys 27, 28 of these units. The V-belt pulley 23 extends through and outside the frontal cover 19 so that the V-belt 26 is sited externally of the encapsulation. A block 29 of sound-absorbing material is provided in the region of the pulley 23 and the belt 26 and provides a funnel-shaped passage 30 which is substantially V-shaped in outline and of slightly greater width than the V-belt 26. The arrows 31, 32 show the way in which cooling air is drawn into the capsule 2 through this passage 30. The cross-sectional configuration of the funnel passage 30 which follows in a slightly spaced apart relationship the contour lines of belt pulley 23 and V-belt 26, ensures highly efficient sound absorption with regard to air-intake noise as well as to noise emanating from openings in the frontal cover 19 through which the pulley 23 extends.

The block 29 is preferably a lining secured to a casing secured to the frontal cover 19 in any suitable manner. The block 29 may be adhesively secured to the frontal cover. The arrangement of the sound-absorbing block 29 in relation to the V-belt pulley 23 provides a sound absorbing silencer unit forming part of the encapsulation for the engine and the pulley 23 and providing a leadthrough from the encapsulation for the V-belt and air whilst the auxiliary equipment is outside the encapsulation and readily accessible.

Owing to the suction draft induced by the fan 16, cooling air can only flow inwardly through the passage 30 towards the capsule interior. Preferably, an air outlet is sited at the point where the exhaust pipe 33 is conducted through the walls of the capsule, however, this is not shown in the drawings.

I claim:

1. An internal combustion engine with auxiliary machines driven by a V-belt and pulley from the engine, the engine and the pulley being enclosed by a sound suppressing encapsulation, the auxiliary machines being mounted externally of the encapsulation, the V-belt extending at least partly through a sound absorbing funnelshaped leadthrough to the pulley, the funnel-shaped leadthrough providing a silencer unit and a passageway for the intake of cooling air into the encapsulation.

2. An internal combustion engine according to claim 1, the funnel-shaped leadthrough having the form of a continuous slot following the contour outline of the V-belt and the pulley in slightly spaced-apart relationship therewith.

3. An internal combustion engine according to claim 1, the funnel-shaped leadthrough being formed in a block of sound-absorbing material, said block being secured to a frontal cover part of the encapsulation.

* * * * *